US009776038B1

(12) United States Patent
Chuang

(10) Patent No.: US 9,776,038 B1
(45) Date of Patent: Oct. 3, 2017

(54) ROWING SIMULATION TRAINER

(71) Applicant: HIGH SPOT HEALTH TECHNOLOGY CO., LTD., Taichung (TW)

(72) Inventor: Yen-Chi Chuang, Taichung (TW)

(73) Assignee: High Spot Health Technology Co., Ltd., Taichung (TW)

( * ) Notice: Subject to any disclaimer, the term of this patent is extended or adjusted under 35 U.S.C. 154(b) by 15 days.

(21) Appl. No.: 15/073,727

(22) Filed: Mar. 18, 2016

(51) Int. Cl.

| | |
|---|---|
| ***A63B 69/06*** | (2006.01) |
| ***A63B 22/00*** | (2006.01) |
| ***A63B 21/00*** | (2006.01) |
| ***A63B 24/00*** | (2006.01) |
| ***H02K 7/10*** | (2006.01) |

(52) U.S. Cl.
CPC ..... *A63B 22/0076* (2013.01); *A63B 21/151* (2013.01); *A63B 21/4035* (2015.10); *A63B 22/0087* (2013.01); *A63B 24/0087* (2013.01); *H02K 7/1004* (2013.01); *A63B 2022/0079* (2013.01); *A63B 2220/20* (2013.01); *A63B 2220/51* (2013.01)

(58) Field of Classification Search
USPC ..... 482/72
See application file for complete search history.

(56) References Cited

U.S. PATENT DOCUMENTS

| | | | | |
|---|---|---|---|---|
| 5,779,600 A * | 7/1998 | Pape | A63B 22/0076 | 482/119 |
| 5,826,897 A * | 10/1998 | Beard | A61G 5/023 | 280/217 |
| 8,845,497 B2 * | 9/2014 | Turner | A63B 21/00069 | 482/115 |
| 2005/0277521 A1 * | 12/2005 | Lat | A63B 21/154 | 482/72 |

* cited by examiner

*Primary Examiner* — Stephen R Crow
(74) *Attorney, Agent, or Firm* — Alan D. Kamrath; Kamrath IP Lawfirm, P.A.

(57) ABSTRACT

A rowing simulation trainer includes a base frame, a pulling unit, an inertia wheel unit and a guiding unit. The pulling unit includes a shaft, a first belt wheel, two cord wheels, two pulling cords, two handgrips and two elastic coiled plates. The guiding unit includes two mounting tubes. Each of the two pulling cords extends through one of the two mounting tubes. Thus, the two cord wheels and the two pulling cords cooperate to drive the inertia wheel unit and are respectively operated independently without interfering with each other. In addition, the two pulling cords are limited by the two mounting tubes so that the two pulling cords are kept in line with and will not be deflected from the two cord wheels.

12 Claims, 9 Drawing Sheets

ROWING SIMULATION TRAINER

BACKGROUND OF THE INVENTION

1. Field of the Invention

The present invention relates to an exercising device and, more particularly, to a rowing simulation trainer.

2. Description of the Related Art

A conventional row exercising device comprises a frame, a sliding seat mounted on the frame, two foot support mounted on the frame, two handles pivotally mounted on the frame, and two hydraulic damping mechanisms pivotally connected with the two handles. In operation, when a user pulls the two handles, the two handles are pivoted relative to the frame, and the sliding seat is slidable on the frame, so that the user can simulate a rowing action. At this time, the two hydraulic damping mechanisms provide a damping force to the two handles so that the user has to overcome the damping force, thereby achieving an exercising function.

BRIEF SUMMARY OF THE INVENTION

In accordance with the present invention, there is provided a rowing simulation trainer comprising a base frame, a pulling unit mounted on the base frame, and an inertia wheel unit mounted on the base frame and located beside the pulling unit. The pulling unit includes a first fixed bracket mounted on the base frame and having two sidewalls, a shaft pivotally mounted on the two sidewalls of the first fixed bracket, a first belt wheel secured on the shaft, two cord wheels mounted on the shaft and each having a oneway bearing module, two pulling cords each having a first end secured on one of the two cord wheels, two handgrips each connected with a second end of one of the two pulling cords, two elastic coiled plates mounted on the shaft, and two dustproof covers mounted on the shaft. The inertia wheel unit includes a second fixed bracket mounted on the base frame and having two sidewalls, a rod pivotally mounted on the two sidewalls of the second fixed bracket, an inertia wheel secured on the rod, a second belt wheel secured on the rod and rotatable in concert with the inertia wheel, and a first driving belt mounted between the first belt wheel and the second belt wheel.

According to the primary advantage of the present invention, the two elastic coiled plates, the two cord wheels and the two pulling cords cooperate to drive the inertia wheel unit and are respectively operated independently without interfering with each other, so that only a single inertia wheel unit is needed without having to provide two inertia wheel units, thereby decreasing the cost of fabrication and assembly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
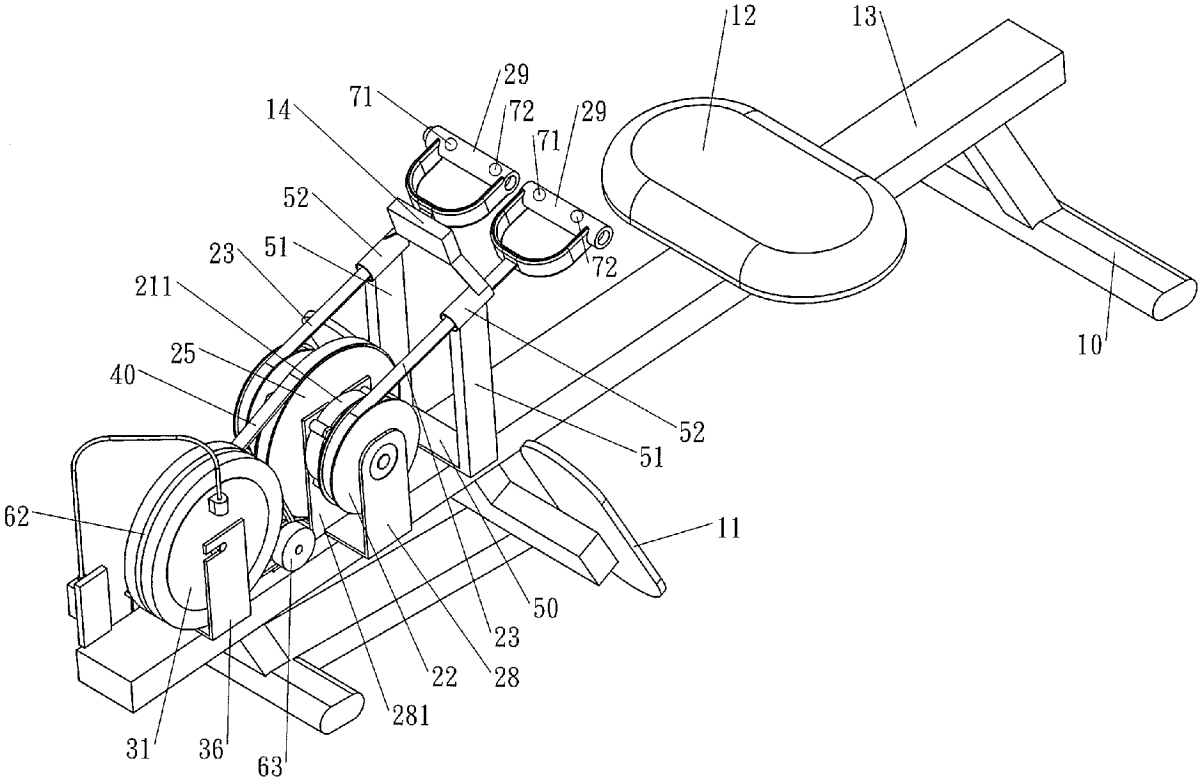
FIG. 1 is a perspective view of a rowing simulation trainer in accordance with the preferred embodiment of the present invention.
Figure 2:
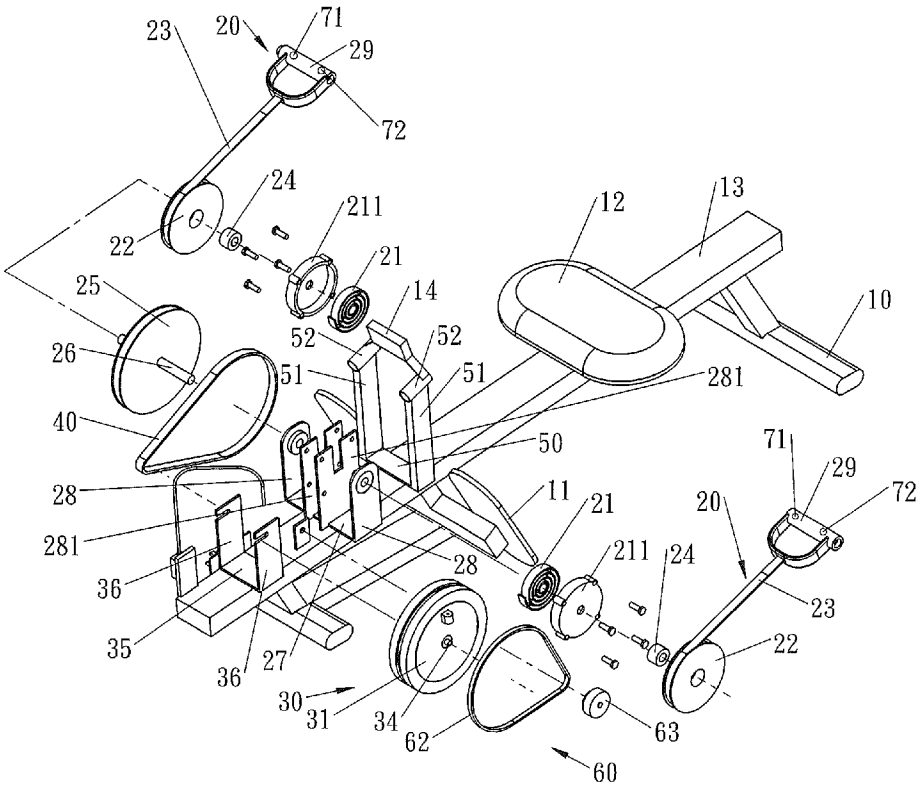
FIG. 2 is an exploded perspective view of the rowing simulation trainer as shown in FIG. 1.
Figure 3:
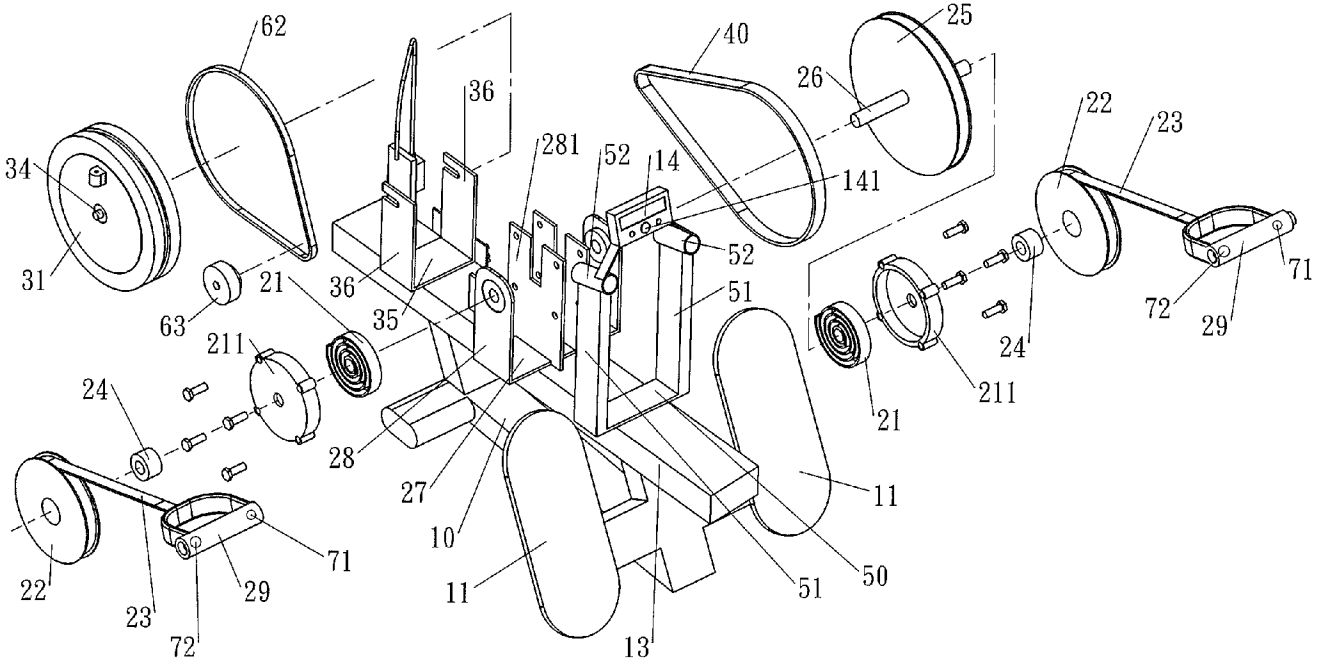
FIG. 3 is another exploded perspective view of the rowing simulation trainer in accordance with the preferred embodiment of the present invention.
Figure 4:
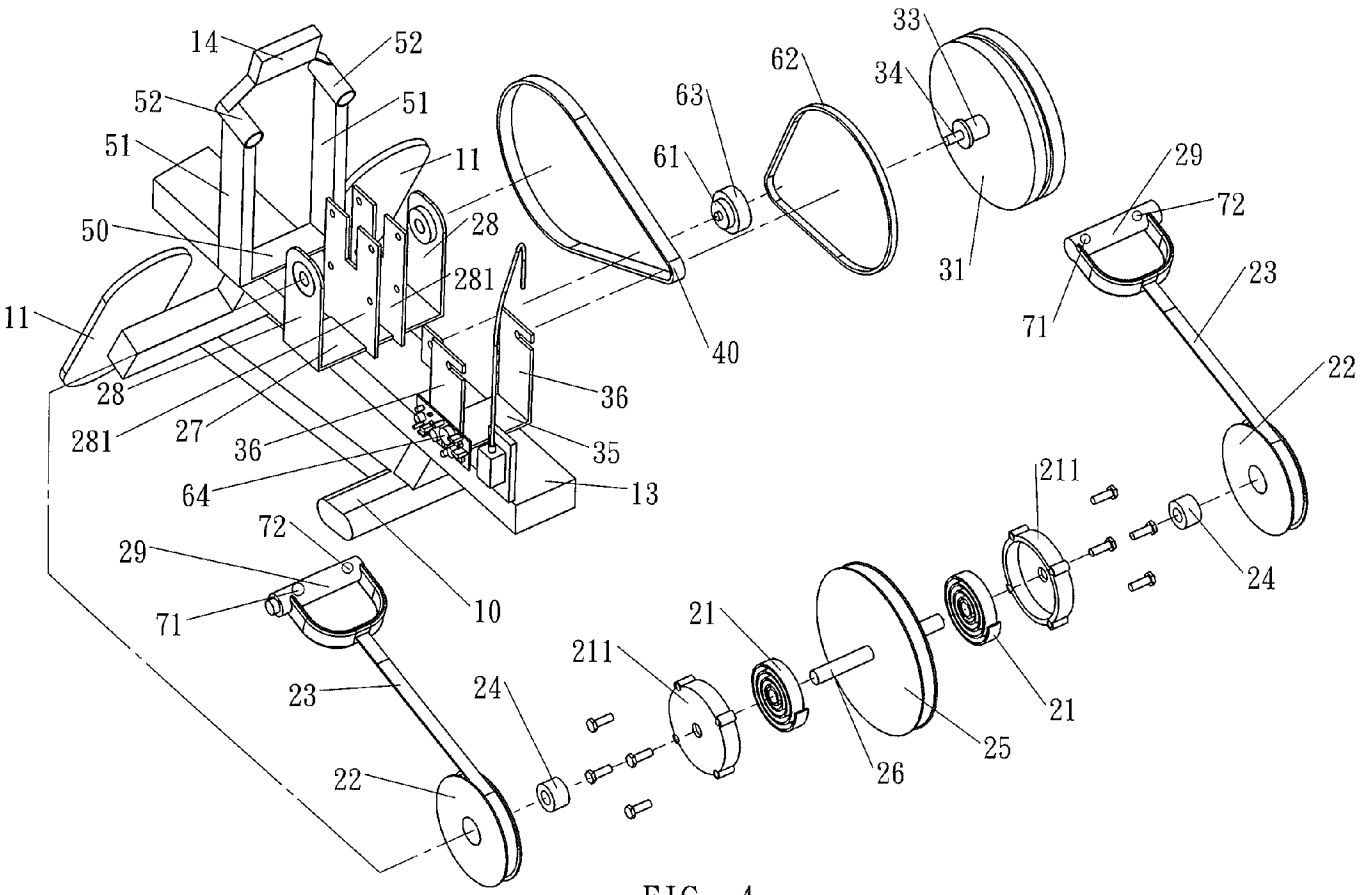
FIG. 4 is another exploded perspective view of the rowing simulation trainer in accordance with the preferred embodiment of the present invention.

Referring to the drawings and initially to FIGS. 1-5, a rowing simulation trainer in accordance with the preferred embodiment of the present invention comprises a base frame 10, a pulling unit 20 mounted on the base frame 10, and an inertia wheel unit 30 mounted on the base frame 10 and located beside the pulling unit 20.

The base frame 10 includes a longitudinal support bar 13 for mounting the pulling unit 20 and the inertia wheel unit 30, two foot supports 11 mounted on the support bar 13, and a seat 12 mounted on the support bar 13.

The pulling unit 20 is mounted on the front section of the support bar 13 of the base frame 10 and includes a substantially U-shaped first fixed bracket 27 mounted on the base frame 10 and having two sidewalls 28, a shaft 26 pivotally mounted on the two sidewalls 28 of the first fixed bracket 27, a first belt wheel 25 secured on the shaft 26, two cord wheels 22 mounted on the shaft 26 and each having a oneway bearing module 24, two pulling cords 23 each having a first end secured on one of the two cord wheels 22, two handgrips 29 each connected with a second end of one of the two pulling cords 23, two elastic coiled plates 21 mounted on the shaft 26, and two dustproof covers 211 mounted on the shaft 26.

The two elastic coiled plates 21, the two cord wheels 22 and the two pulling cords 23 are respectively operated independently without interfering with each other. Each of the two handgrips 29 is provided with a gravity sensor 71 and a bluetooth transmitter 72. Each of the two elastic coiled plates 21 is received in one of the two dustproof covers 211 and has a first end secured on the shaft 26 and a second end secured on one of the two dustproof covers 211. The oneway bearing module 24 of each of the two cord wheels 22 is secured on the shaft 26. The pulling unit 20 further includes two baffle plates 281 mounted in the first fixed bracket 27 and arranged between the two sidewalls 28 of the first fixed bracket 27. Each of the two dustproof covers 211 is secured on one of the two baffle plates 281. Each of the two cord wheels 22 is located beside one of the two dustproof covers 211.

The inertia wheel unit 30 is mounted on the front section of the support bar 13 of the base frame 10 and includes a substantially U-shaped second fixed bracket 35 mounted on the base frame 10 and having two sidewalls 36, a rod 34 pivotally mounted on the two sidewalls 36 of the second fixed bracket 35, an inertia wheel 31 secured on the rod 34, a second belt wheel 33 (see FIGS. 3 and 4) secured on the rod 34 and rotatable in concert with the inertia wheel 31, and a first driving belt 40 mounted between the first belt wheel 25 and the second belt wheel 33.

The rowing simulation trainer further comprises a guiding unit 50 mounted on the support bar 13 of the base frame 10 and located beside the pulling unit 20. The guiding unit 50 includes two opposite side racks 51, and two hollow mounting tubes 52 secured on the two side racks 51. Each of the two pulling cords 23 initially extends through one of the two mounting tubes 52 and is then connected with one of the two handgrips 29. Each of the two mounting tubes 52 is arranged between one of the two handgrips 29 and one of the two cord wheels 22. An instrument panel 14 is mounted on the guiding unit 50, and a bluetooth receiver 141 (see FIG. 3) is mounted on the instrument panel 14 to receive a wireless signal transmitted from the bluetooth transmitter 72 of each of the two handgrips 29.

The rowing simulation trainer further comprises a generating unit 60 mounted on the base frame 10, and a circuit board 64 (see FIG. 5) mounted on the base frame 10 and electrically connected with the generating unit 60. The generating unit 60 includes a generator 63, a driving wheel 61 (see FIG. 4) pivotally connected with the generator 63, and a second driving belt 62 mounted between the driving wheel 61 and the inertia wheel 31. The generating unit 60 is connected with the instrument panel 14 to supply an electric power to the instrument panel 14.

Figure 5:
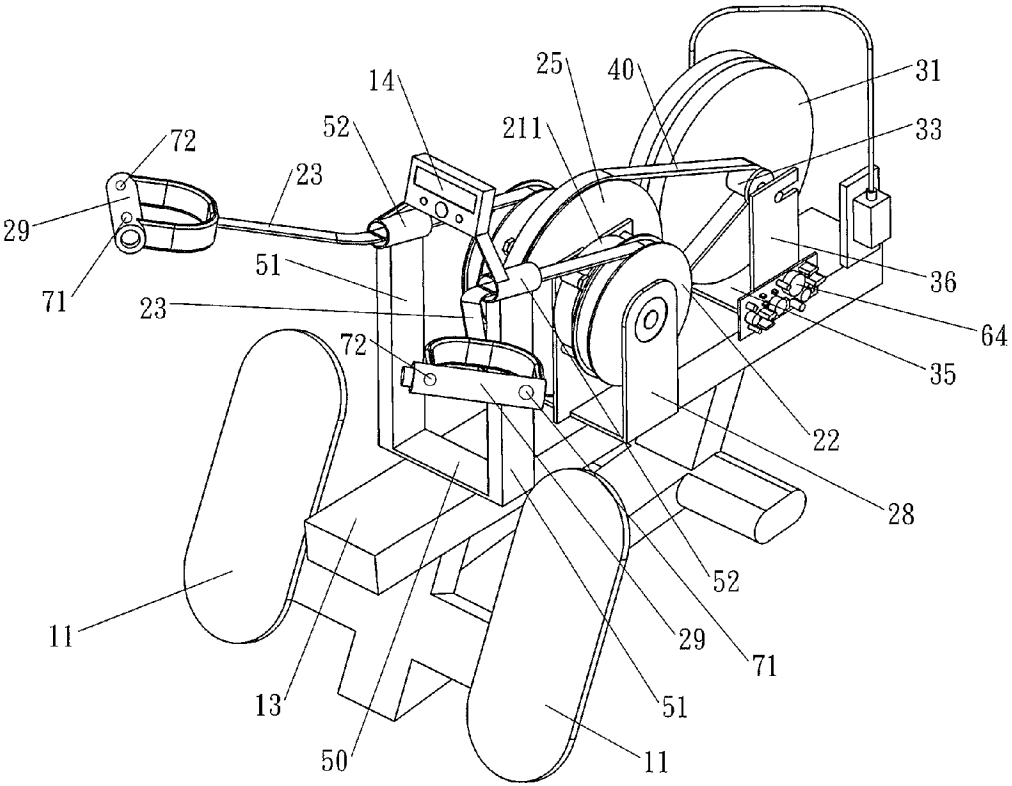
FIG. 5 is another perspective view of the rowing simulation trainer in accordance with the preferred embodiment of the present invention.

In operation, referring to FIG. 5 with reference to FIGS. 1-4, when the two handgrips 29 are pulled by the user, the two pulling cords 23 are pulled out of the two mounting tubes 52 to drive and rotate the two cord wheels 22 which rotate and compress the two elastic coiled plates 21 so that the two elastic coiled plates 21 store a restoring force. At the same time, rotation of the two cord wheels 22 drives and rotates the shaft 26 which rotates the first belt wheel 25 which drives the first driving belt 40 which rotates the second belt wheel 33 which rotates the inertia wheel 31 which drives the second driving belt 62 which rotates the driving wheel 61 which rotates a rotor (not shown) on the generator 63 so that the generator 63 is operated to generate an electric power which is supplied to the instrument panel 14 on the guiding unit 50.

On the contrary, when the user loosens the two handgrips 29, the shaft 26 is driven by the restoring force of the two elastic coiled plates 21 and is rotated in the opposite direction to rotate the two cord wheels 22 which drive the two pulling cords 23 backward so that the two pulling cords 23 are wound around the two cord wheels 22, and the two handgrips 29 are moved to abut the two mounting tubes 52.

Thus, the user pulls and loosens the two handgrips 29 successively to have a damped pulling force and to achieve an exercising function. At this time, the two cord wheels 22 and the two pulling cords 23 are respectively operated independently without interfering with each other during movement of the two cord wheels 22 and the two pulling cords 23.

In addition, when the two handgrips 29 are pulled by the user, the gravity sensor 71 on each of the two handgrips 29 detects data, including the movement direction, force and displacement of each of the two handgrips 29, and converts the data into a signal. Then, the bluetooth transmitter 72 on each of the two handgrips 29 transmits the signal to the bluetooth receiver 141 on the instrument panel 14. Then, the instrument panel 14 transmits a control signal to the generating unit 60 to control a resistance coefficient of the generator 63 so as to change the damping force applied on the two handgrips 29 when the user pulls the two handgrips 29.

Figure 6:
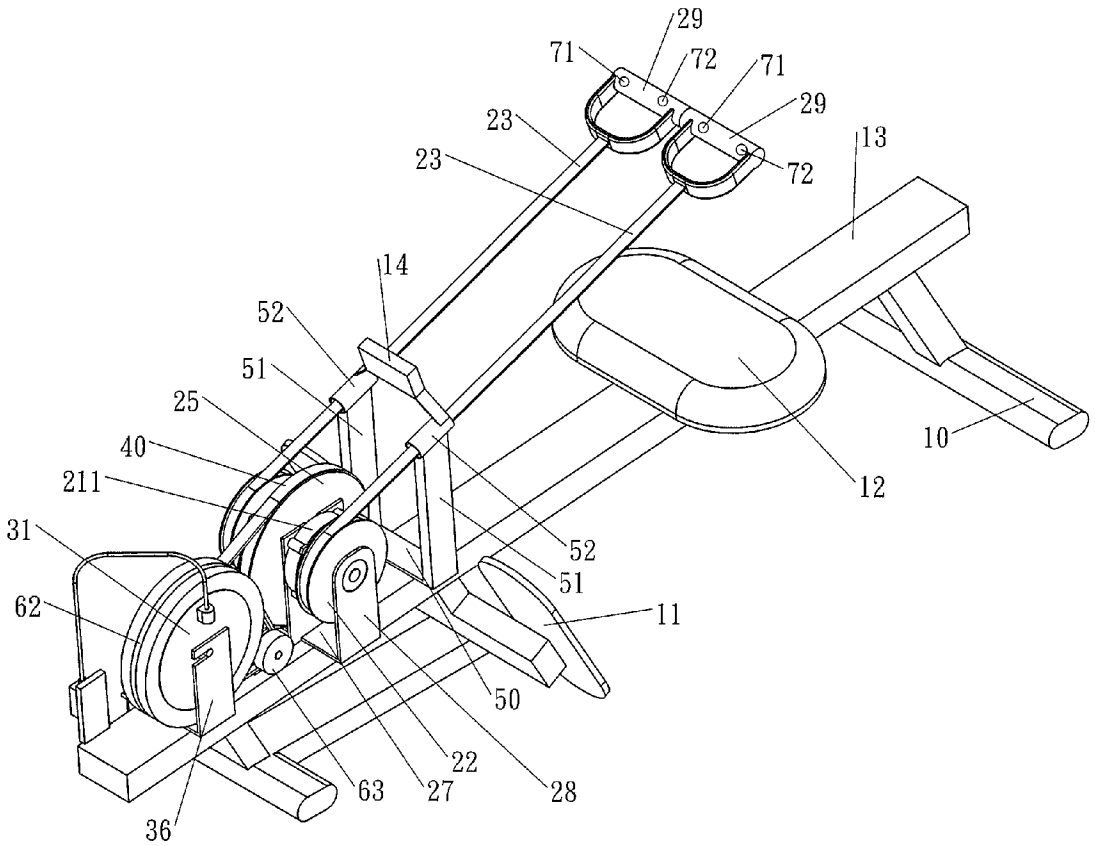
FIG. 6 is a schematic operational view of the rowing simulation trainer as shown in FIG. 1 in use.

Referring to FIG. 6, the two handgrips 29 are connected with each other so as to drive the two pulling cords 23 simultaneously.

Figure 7:
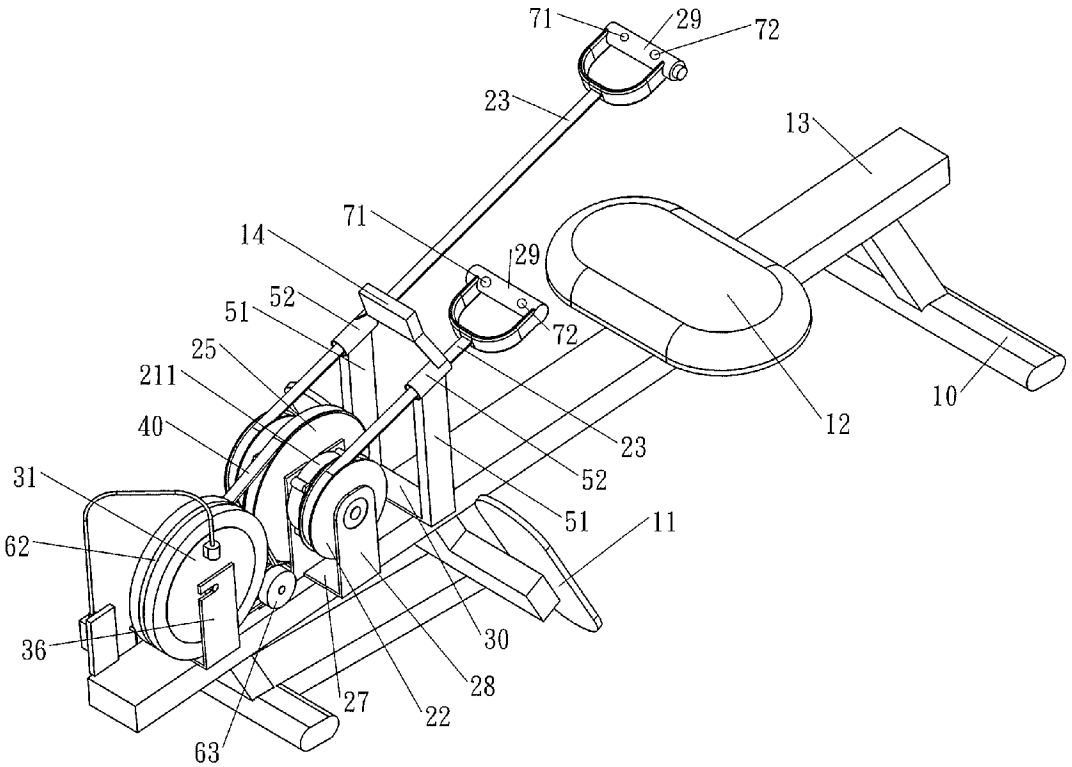
FIG. 7 is another schematic operational view of the rowing simulation trainer as shown in FIG. 1 in use.

Referring to FIG. 7, only one of the two handgrips 29 is pulled so as to drive one of the two pulling cords 23 individually by the user's one hand.

Figure 8:
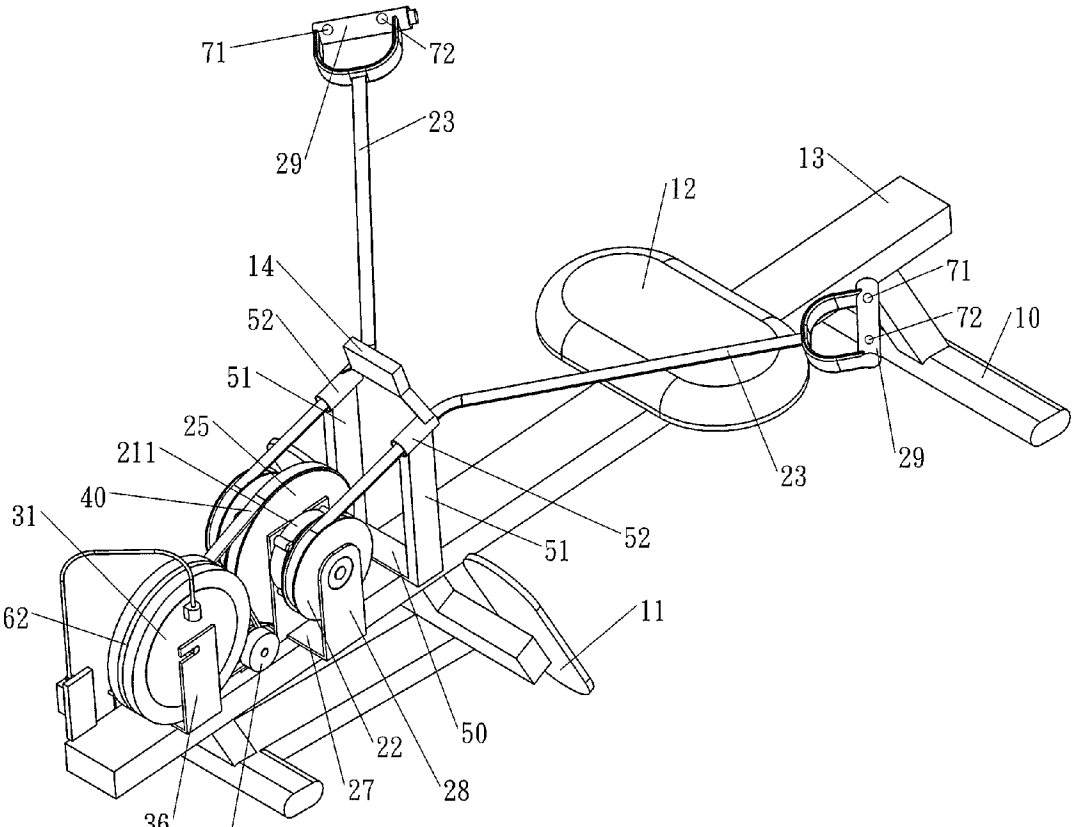
FIG. 8 is another schematic operational view of the rowing simulation trainer as shown in FIG. 1 in use.

Referring to FIG. 8, the two handgrips 29 are pulled outward relative to each other to drive the two pulling cords 23 outward relative to each other so as to expand the user's chest.

Figure 9:
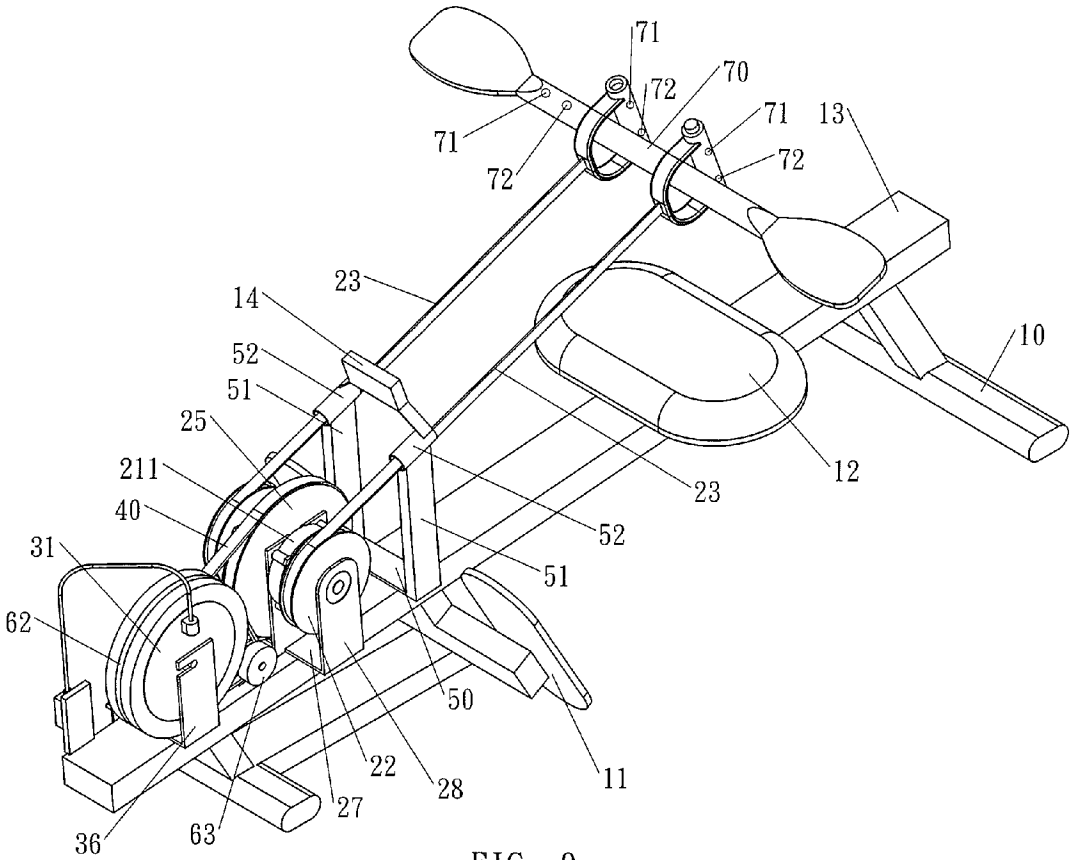
FIG. 9 is a perspective operational view of the rowing simulation trainer in accordance with another preferred embodiment of the present invention.

Referring to FIG. 9, an oar 70 extends through and is mounted on the two handgrips 29. The oar 70 is also provided with the gravity sensor 71 and the bluetooth transmitter 72. In such a manner, when the oar 70 is pulled by the user, the gravity sensor 71 on the oar 70 detects data, including the movement direction, force and displacement of the oar 70, and converts the data into a signal. Then, the bluetooth transmitter 72 on the oar 70 transmits the signal to the bluetooth receiver 141 on the instrument panel 14. Then, the instrument panel 14 transmits a control signal to the generating unit 60 to control a resistance coefficient of the generator 63 so as to change the damping force applied on the oar 70 when the user pulls the oar 70.

Accordingly, the two elastic coiled plates 21, the two cord wheels 22 and the two pulling cords 23 cooperate to drive the inertia wheel unit 30 and are respectively operated independently without interfering with each other, so that only a single inertia wheel unit 30 is needed without having to provide two inertia wheel units 30, thereby decreasing the cost of fabrication and assembly. In addition, the two pulling cords 23 extends through and are limited by the two mounting tubes 52 so that the two pulling cords 23 are kept in line with and will not be deflected from the two cord wheels 22 during movement of a larger angle and a larger range as shown in FIG. 8, such that the two pulling cords 23 will not be jammed with the two cord wheels 22 and can drive the two cord wheels 22 exactly and smoothly. Further, the pulling unit 20, the inertia wheel unit 30 and the guiding unit 50 are juxtaposed to each other so as to shorten the whole volume of the rowing simulation trainer, thereby saving the space, and thereby decreasing the cost of storage, packaging and transportation.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A rowing simulation trainer comprising:

a base frame;

a pulling unit mounted on the base frame; and an inertia wheel unit mounted on the base frame and located beside the pulling unit;

wherein:

the pulling unit includes:

a first fixed bracket mounted on the base frame and having two sidewalls;

a shaft pivotally mounted on the two sidewalls of the first fixed bracket;

a first belt wheel secured on the shaft;

two cord wheels mounted on the shaft and each having a oneway bearing module;

two pulling cords each having a first end secured on one of the two cord wheels;

two handgrips each connected with a second end of one of the two pulling cords;

two elastic coiled plates mounted on the shaft; and two dustproof covers mounted on the shaft; and the inertia wheel unit includes:

a second fixed bracket mounted on the base frame and having two sidewalls;

a rod pivotally mounted on the two sidewalls of the second fixed bracket;

an inertia wheel secured on the rod;

a second belt wheel secured on the rod and rotatable in concert with the inertia wheel; and a first driving belt mounted between the first belt wheel and the second belt wheel.

2. The rowing simulation trainer of claim 1, wherein the base frame includes a support bar for mounting the pulling unit and the inertia wheel unit.

3. The rowing simulation trainer of claim 1, wherein the two cord wheels and the two pulling cords are respectively operated independently without interfering with each other.

4. The rowing simulation trainer of claim 1, wherein the two handgrips are connected with each other.

5. The rowing simulation trainer of claim 1, wherein each of the two handgrips is provided with a gravity sensor and a bluetooth transmitter.

6. The rowing simulation trainer of claim 1, further comprising an oar extending through and mounted on the two handgrips, wherein the oar is provided with a gravity sensor and a bluetooth transmitter.

7. The rowing simulation trainer of claim 1, wherein each of the two elastic coiled plates has a first end secured on the shaft and a second end secured on one of the two dustproof covers, and the oneway bearing module of each of the two cord wheels is secured on the shaft.

8. The rowing simulation trainer of claim 1, wherein the pulling unit further includes two baffle plates mounted in the first fixed bracket and arranged between the two sidewalls of the first fixed bracket, each of the two dustproof covers is secured on one of the two baffle plates, and each of the two cord wheels is located beside one of the two dustproof covers.

9. The rowing simulation trainer of claim 5, further comprising a guiding unit mounted on the base frame and located beside the pulling unit, wherein the guiding unit includes two opposite side racks, and two mounting tubes secured on the two side racks, each of the two pulling cords extends through one of the two mounting tubes, and each of the two mounting tubes is arranged between one of the two handgrips and one of the two cord wheels.

10. The rowing simulation trainer of claim 9, further comprising an instrument panel mounted on the guiding unit, and a bluetooth receiver mounted on the instrument panel to receive a signal transmitted from the bluetooth transmitter of each of the two handgrips.

11. The rowing simulation trainer of claim 1, further comprising a generating unit mounted on the base frame, and a circuit board mounted on the base frame and electrically connected with the generating unit, wherein the generating unit includes a generator, a driving wheel pivotally connected with the generator, and a second driving belt mounted between the driving wheel and the inertia wheel, and the generating unit is connected with the instrument panel to supply an electric power to the instrument panel.

12. The rowing simulation trainer of claim 1, wherein the base frame includes two foot supports mounted on the support bar, and a seat mounted on the support bar.

* * * * *